US010136775B2

(12) United States Patent
Ichihara et al.

(10) Patent No.: US 10,136,775 B2
(45) Date of Patent: Nov. 27, 2018

(54) TOILET BOWL APPARATUS AND SEAL MEMBER

(71) Applicant: Lixil Corporation, Tokyo (JP)

(72) Inventors: Saori Ichihara, Tokyo (JP); Isato Hirasawa, Tokyo (JP); Yasuhiro Kondo, Tokyo (JP); Takeya Ichiyanagi, Tokyo (JP)

(73) Assignee: Lixil Corporation, Tokyo (JP)

( * ) Notice: Subject to any disclaimer, the term of this patent is extended or adjusted under 35 U.S.C. 154(b) by 0 days.

(21) Appl. No.: 15/480,869

(22) Filed: Apr. 6, 2017

(65) Prior Publication Data

US 2017/0290475 A1 Oct. 12, 2017

(30) Foreign Application Priority Data

Apr. 11, 2016 (JP) ..... 2016-078965

(51) Int. Cl.

| | |
|---|---|
| ***E03D 9/00*** | (2006.01) |
| ***A47K 13/24*** | (2006.01) |
| ***E03D 11/02*** | (2006.01) |
| *E03D 9/08* | (2006.01) |

(52) U.S. Cl.

CPC ..... *A47K 13/24* (2013.01); *E03D 11/02* (2013.01); *E03D 9/08* (2013.01)

(58) Field of Classification Search

CPC ..... E03D 9/00
USPC ..... 4/300–442
See application file for complete search history.

(56) References Cited

U.S. PATENT DOCUMENTS

| | | | | |
|---|---|---|---|---|
| 4,433,443 | A * | 2/1984 | DeGraw | E03D 5/016 204/240 |
| 4,519,103 | A * | 5/1985 | De Graw | E03D 5/016 204/240 |
| 4,558,473 | A * | 12/1985 | Morikawa | E03D 9/08 4/213 |
| 8,978,172 | B2 * | 3/2015 | Plate | E03D 1/01 4/300 |
| 9,170,720 | B2 * | 10/2015 | Plate | A47K 13/24 |
| 9,382,137 | B2 * | 7/2016 | Jeong | C02F 1/4674 |
| 9,528,254 | B2 * | 12/2016 | Kuang | E03D 9/08 |
| 9,609,985 | B2 * | 4/2017 | Lodoka | A47K 13/10 |
| 9,657,472 | B2 * | 5/2017 | Plate | E03D 9/00 |

(Continued)

FOREIGN PATENT DOCUMENTS

| | | |
|---|---|---|
| DE | 20015080 U1 | 12/2000 |
| JP | 09228451 A | 9/1997 |

(Continued)

OTHER PUBLICATIONS

European Patent Office, Search Report issued in European Patent Application No. 17165319.9 dated Aug. 14, 2017, 8 pages.

*Primary Examiner* — Lori Baker
(74) *Attorney, Agent, or Firm* — Wood Herron & Evans LLP

(57) ABSTRACT

A toilet bowl apparatus includes: a toilet bowl main body; a functional part installed at an upper section of the toilet bowl main body; a seal member attached to at least one of the toilet bowl main body and the functional part and disposed in a gap between the toilet bowl main body and the functional part, and the seal member includes a soft seal body and an elastic body covered by the soft seal body.

9 Claims, 10 Drawing Sheets

(56) References Cited

U.S. PATENT DOCUMENTS

| | | | | |
|---|---|---|---|---|
| 2011/0113540 | A1* | 5/2011 | Plate | E03D 1/01 4/300 |
| 2012/0005817 | A1* | 1/2012 | Jeong | C02F 1/4674 4/420.4 |
| 2012/0204337 | A1* | 8/2012 | Pohler | B02C 18/0092 4/319 |
| 2013/0219605 | A1* | 8/2013 | Grover | E03D 11/08 4/300.3 |

FOREIGN PATENT DOCUMENTS

| | | | |
|---|---|---|---|
| JP | 2002295686 | A | 10/2002 |
| JP | 2003105830 | A | 4/2003 |
| JP | 2007162272 | A | 6/2007 |
| JP | 2010196375 | A | 9/2010 |

* cited by examiner

TOILET BOWL APPARATUS AND SEAL MEMBER

BACKGROUND OF THE INVENTION

Field of the Invention

The present invention relates to a toilet bowl apparatus and a seal member. Priority is claimed on Japanese Patent Application No. 2016-078965, filed on Apr. 11, 2016, the content of which is incorporated herein by reference.

Description of Related Art

In the related art, a toilet bowl apparatus in which a functional part having various function devices or the like such as a private part cleaning device or the like is installed on a toilet bowl main body is known (for example, see Japanese Unexamined Patent Application, First Publication No. H09-228451). In such a toilet bowl apparatus, a seal member that prevents water in the bowl from entering a gap between the toilet bowl main body and the functional part is provided.

SUMMARY OF THE INVENTION

However, when the shape of the toilet bowl main body or the functional part is complicated, the seal member may buckle or fail to follow the shape of the gap between the toilet bowl main body and the functional part, so that the gap between the toilet bowl main body and the functional part may not be filled. As a result, water or the like scattered from the bowl may intrude into the gap between the toilet bowl main body and the functional part, and therefore, cleaning the toilet may be burdensome task.

Here, the present invention provides a toilet bowl apparatus and a seal member that are capable of reliably filling a gap between a toilet bowl main body and a functional part.

SUMMARY OF THE INVENTION

In order to accomplish the above-mentioned purposes, according to an aspect of the present invention, a toilet bowl apparatus including: a toilet bowl main body; a functional part installed at an upper section of the toilet bowl main body; a seal member attached to at least one of the toilet bowl main body and the functional part and disposed in a gap between the toilet bowl main body and the functional part.

In addition, the seal member according to the aspect of the present invention has a soft seal body and an elastic body covered by the soft seal body.

In the present invention, the seal member has the soft seal body and the elastic body covered by the soft seal body. Accordingly, when the seal member is disposed in the gap between the toilet bowl main body and the functional part, the elastic body is elastically deformed to be a shape that follows the gap between the toilet bowl main body and the functional part, the soft seal body is capable of being prevented from being buckled by a repulsive force of the elastic body and the soft seal body is capable of being close contacted with the toilet bowl main body and the functional part.

According to the aspect of the present invention, in the toilet bowl apparatus, a concave section in which at least a lower section side of the functional part is disposed may be formed in the toilet bowl main body, and the seal member may be disposed in a gap between a bottom surface of the concave section and the functional part.

According to the above-mentioned configuration, a height at which the functional part is installed is capable of being reduced in comparison with the case in which the functional part is disposed at upper side than the upper end section of the toilet bowl main body, and the toilet bowl apparatus having a low height in a compact design is capable of being realized.

In addition, although a position at which the gap between the toilet bowl main body and the functional part is lowered and water is likely to enter the gap between the toilet bowl main body and the functional part in comparison with the case in which the functional part is disposed at upper side than the upper end section of the toilet bowl main body, as the seal member is disposed in the gap, water is capable of being prevented from intruding into the gap between the toilet bowl main body and the functional part.

According to the aspect of the present invention, in the toilet bowl apparatus, the soft seal body may have a U shape in a cross-sectional shape and the elastic body may be disposed on an inner side of the soft seal body.

According to the above-mentioned configuration, since the soft seal body and the elastic body close contact with each other and a repulsive force of the elastic body is reliably applied to the soft seal body, the seal member is capable of following a shape of the gap between the toilet bowl main body and the functional part, and the gap between the toilet bowl main body and the functional part is capable of being reliably filled.

According to the aspect of the present invention, in the toilet bowl apparatus, the seal member may have a thickness that is partially different in accordance with dimensions of the gap between the toilet bowl main body and the functional part.

According to the above-mentioned configuration, even when a size of the gap between the toilet bowl main body and the functional part varies, since the seal member has a shape corresponding to a shape of the gap between the toilet bowl main body and the functional part, the seal member is capable of reliably filling the gap between the toilet bowl main body and the functional part.

According to the present invention, since the gap between the toilet bowl main body and the functional part can be reliably filled, water scattered from the bowl does not intrude into the gap between the toilet bowl main body and the functional part, and time and effort for cleaning the toilet is capable of being reduced.

DETAILED DESCRIPTION OF THE INVENTION

Hereinafter, a toilet bowl apparatus and a seal member according to an embodiment of the present invention will be described on the basis of FIGS. 1 to 11.

Figure 1:
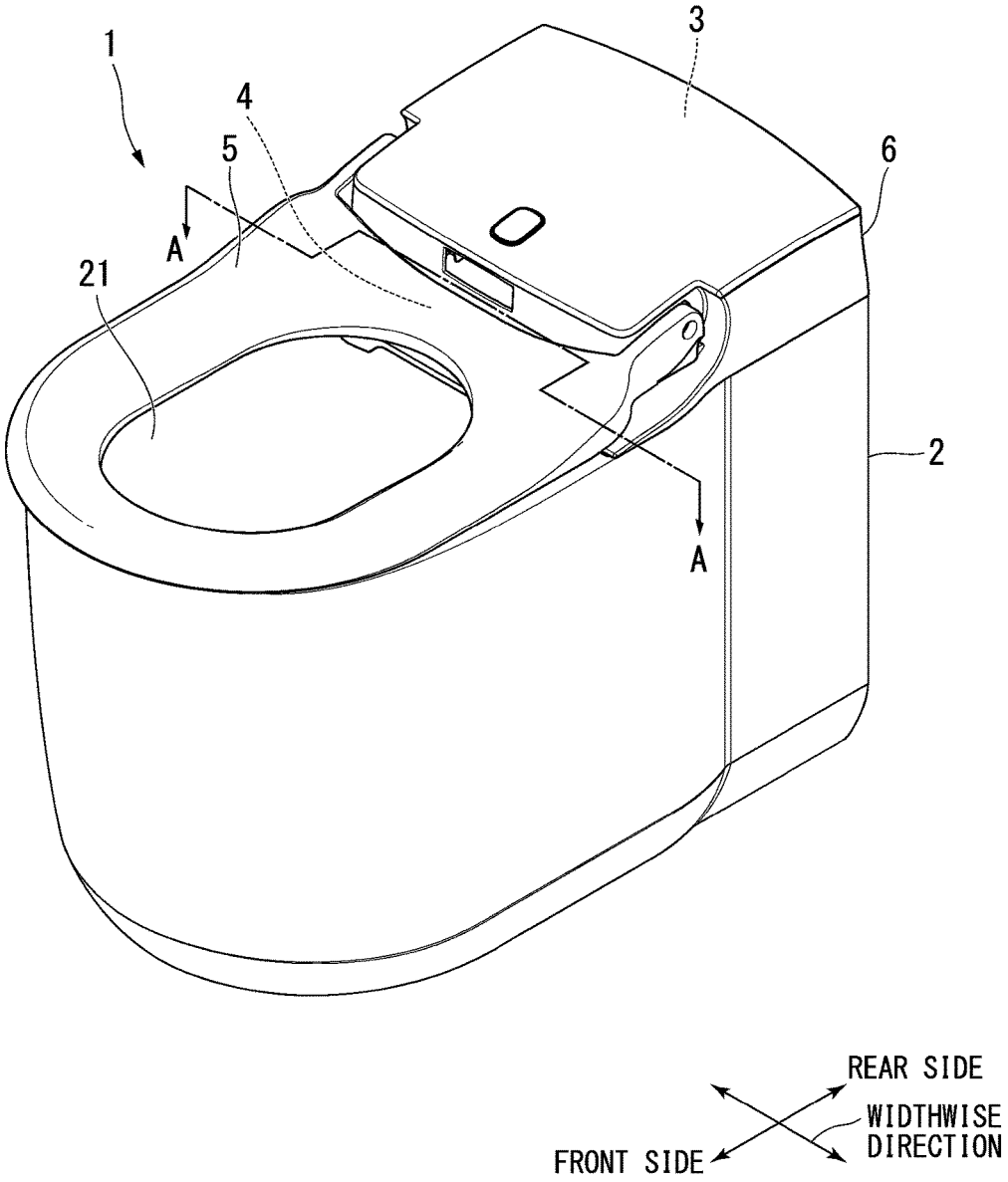
FIG. 1 is a perspective view showing an example of a toilet bowl apparatus according to an embodiment of the present invention.
Figure 2:
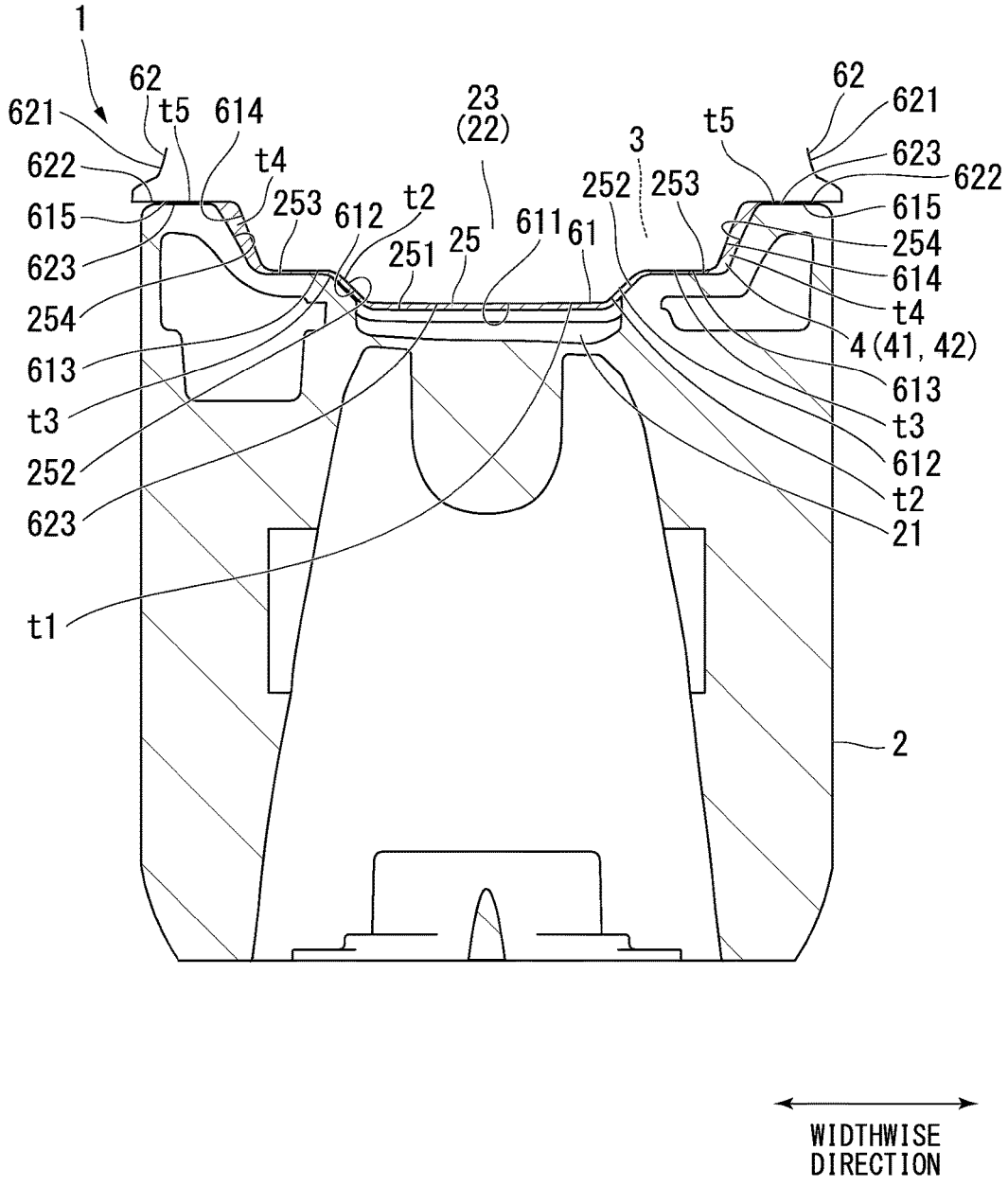
FIG. 2 is a cross-sectional view taken along line A-A of FIG. 1.

As shown in FIGS. 1 and 2, a toilet bowl apparatus 1 according to the embodiment has a toilet bowl main body 2 in which a bowl 21 is formed, a functional part 3, and a seal member 4. The functional part 3 is installed at an upper section of the toilet bowl main body 2. The seal member 4 is disposed in a gap between the toilet bowl main body 2 and the functional part 3. The toilet bowl apparatus 1 has a toilet seat 5 (see FIG. 1) and a toilet cover (not shown) that are installed at the upper section of the toilet bowl main body 2 and pivotally supported by the functional part 3.

The functional part 3 has various function devices, function parts, or the like, such as a private part cleaning device, a deodorizer, an opening/closing device configured to open and close the toilet seat 5 or the toilet cover, and so on, and a case 6 configured to accommodate the various function devices, function parts, or the like.

Here, a side of the toilet bowl apparatus 1 at which the functional part 3 is installed is referred to as a rear side in a forward-rearward direction, and a side at which the toilet seat 5 is installed is referred to as a front side in the forward-rearward direction. A horizontal direction perpendicular to the forward-rearward direction is referred to as a widthwise direction. Both end portions with respect to a central section in the widthwise direction are referred to as outer sides, and a side closer to the central section with respect to both end portions is referred to as an inner side.

Figure 3:
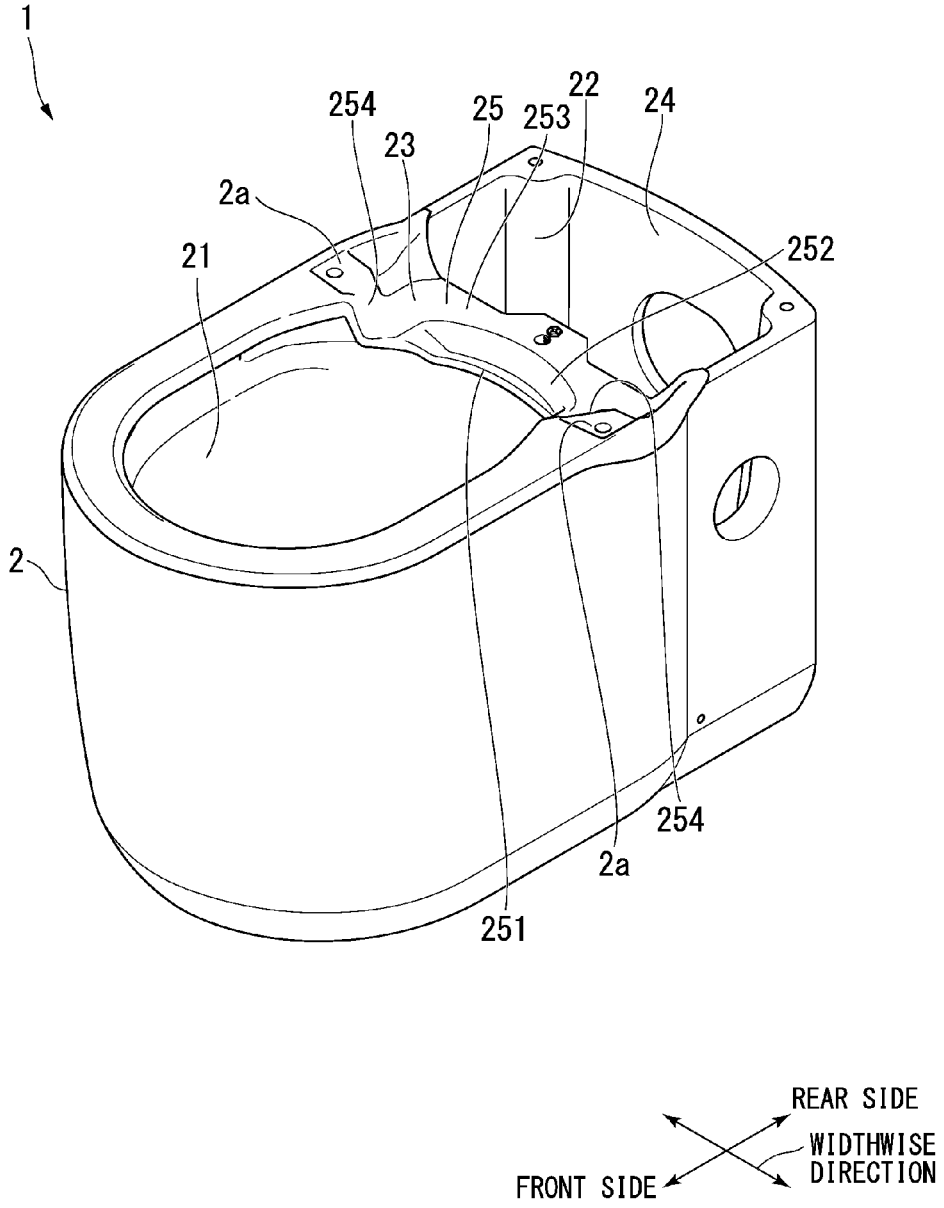
FIG. 3 is a perspective view for describing a toilet bowl main body.

As shown in FIG. 3, in the toilet bowl main body 2, the bowl 21 is formed at a front side portion of the toilet bowl main body 2 and a functional part installation space 22 is formed at a side rear to the bowl 21. The bowl 21 has a shape in a plan view is a substantially long round shape elongated in the forward-rearward direction. The functional part 3 (see FIG. 1) is installed at the functional part installation space 22.

A front side portion 23 of the functional part installation space 22 is formed at an upper section side of the toilet bowl main body 2, and a bottom section of the functional part installation space 22 is disposed at an intermediate section in a height direction of the toilet bowl main body 2. A rear side portion 24 of the functional part installation space 22 is formed over substantially the whole of the toilet bowl main body 2 in the height direction, and a bottom section also functions as a bottom section of the toilet bowl main body 2. A front edge portion of the functional part installation space 22 is curved to protrude toward the rear side along a rear section side of an inner surface of the bowl 21.

A concave section 25 is formed in the front side portion 23 of the functional part installation space 22. The concave section 25 is formed on an inner side in the widthwise direction to be recessed downward and opening at an upper side and a front side of the front side portion 23. In a state in which the functional part 3 is not installed, the concave section 25 communicates with the bowl 21 in the forward-rearward direction.

The concave section 25 has a first concave section bottom surface 251, a first concave section inclined surface 252, a second concave section bottom surface 253, and a pair of second concave section inclined surfaces 254. The first concave section bottom surface 251 is formed at an intermediate portion in a widthwise direction in the vicinity of the front edge portion and is a substantially horizontal surface. The first concave section inclined surface 252 is an inclined surface inclined gradually upward from both edge portions of the first concave section bottom surface 251 toward a widthwise outer side and inclined gradually upward from a rear edge portion of the first concave section bottom surface 251 toward a rear side. The second concave section bottom surface 253 is a substantially horizontal surface extending from both widthwise end portions and the rear edge portion of the first concave section inclined surface 252 toward a side away from the first concave section inclined surface 252. The pair of second concave section inclined surfaces 254 is inclined surface inclined gradually upward from both widthwise end portions of the second concave section bottom surface 253 toward an outer side in the widthwise direction.

The first concave section bottom surface 251 has an elongated shape elongated in the widthwise direction in a plan view. The first concave section inclined surface 252 is continuously disposed on an outer side of the first concave section bottom surface 251 and is formed in substantially a C shape opening at a front side in a plan view. The second concave section bottom surface 253 is continuously disposed on an outer side of the first concave section inclined surface 252 and is formed in substantially a C shape opening at the front side in a plan view. Upper end sections of the widthwise outer side of the pair of second concave section inclined surfaces 254 continue to an upper surface 2*a* where is vicinity to an edge portion of an outer side of the toilet bowl main body 2 in the widthwise direction.

Returning to FIG. 2, the case 6 has a base section 61 and a cover section 62. The base section 61 is disposed in the functional part installation space 22 and on which various function devices or function parts are placed. A cover section 62 is disposed at an upper side of the toilet bowl main body 2 and configured to cover upper sections and side portions of the various function devices or function parts.

Figure 4:
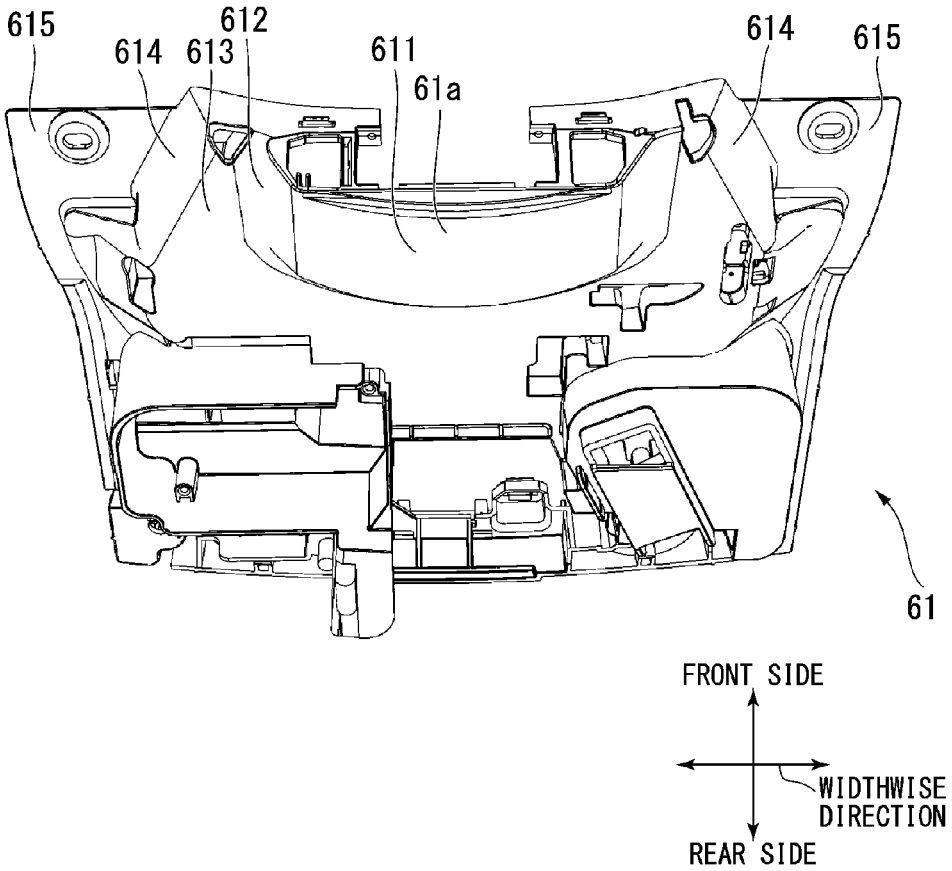
FIG. 4 is a perspective view showing a base section when seen from below.
Figure 5:
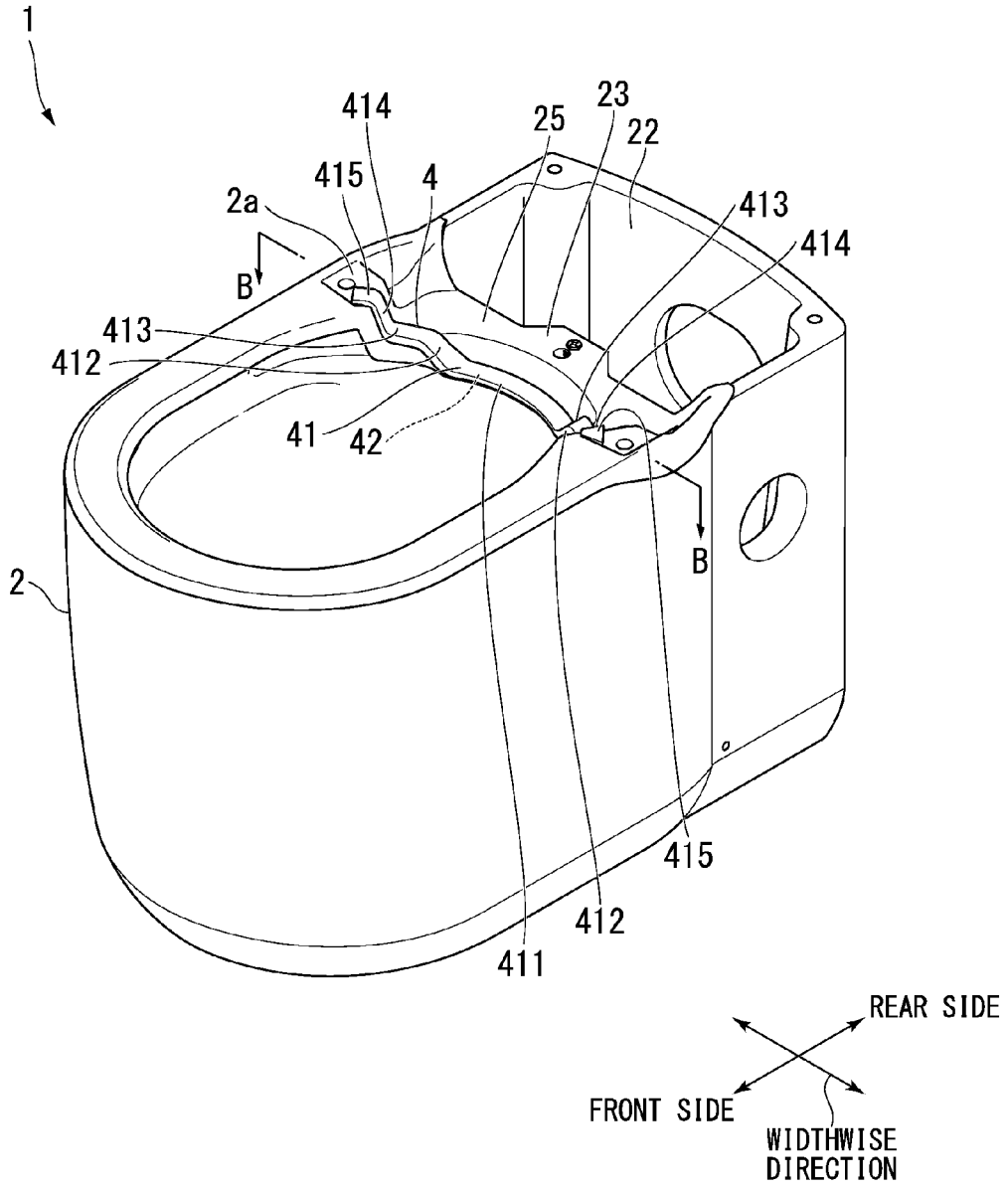
FIG. 5 is a perspective view for describing a seal member.
Figure 6:
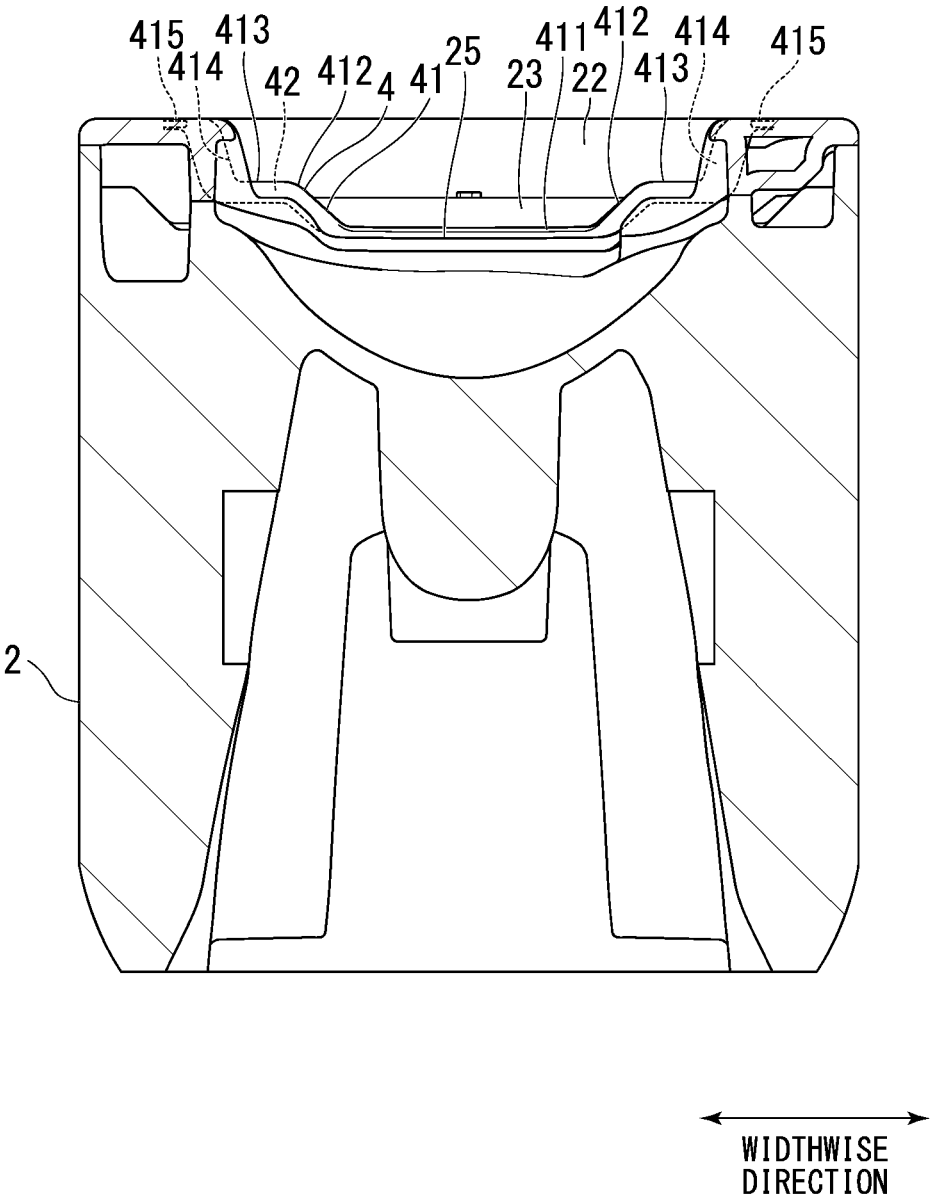
FIG. 6 is a cross-sectional view taken along line B-B of FIG. 5.
Figure 7:
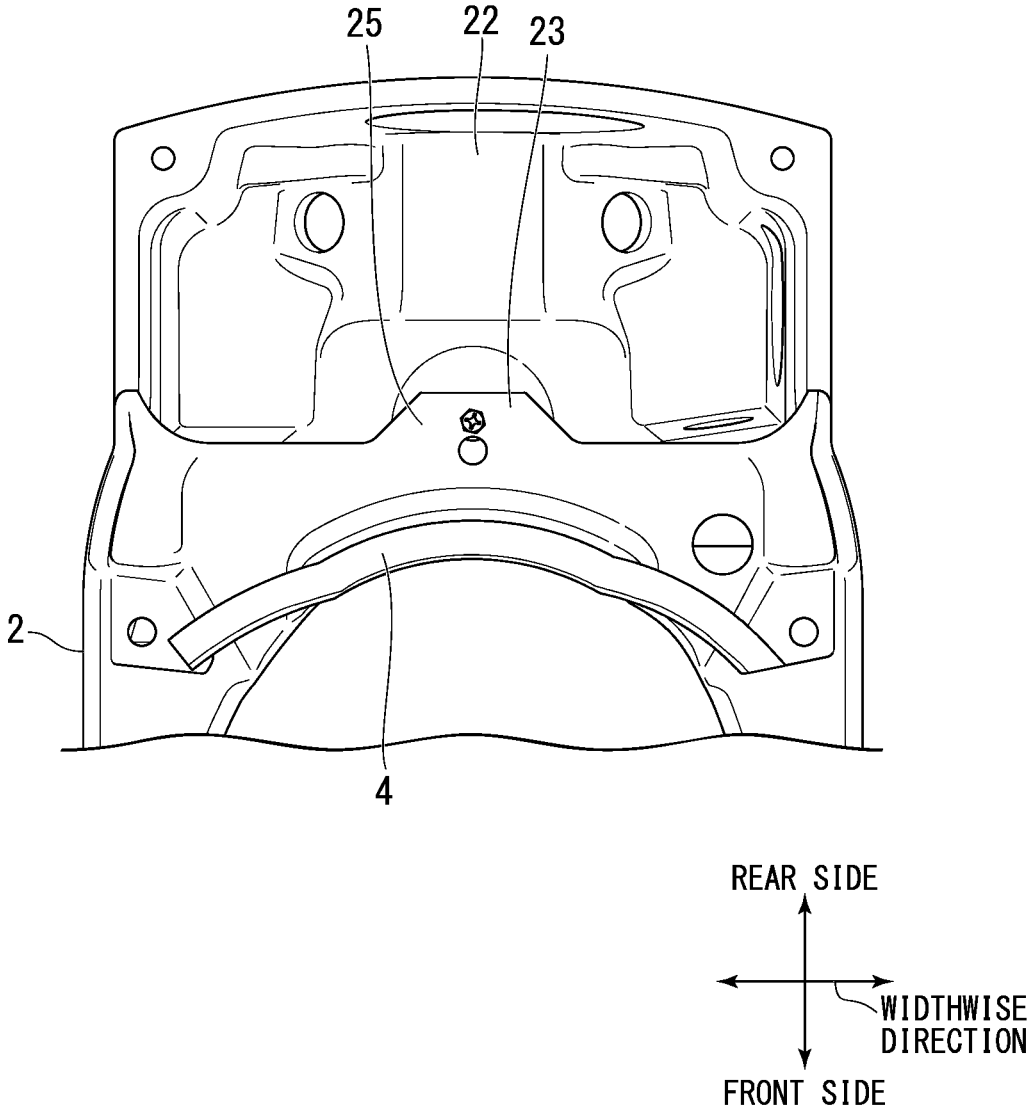
FIG. 7 is a view showing FIG. 5 when seen from above.
Figure 8:
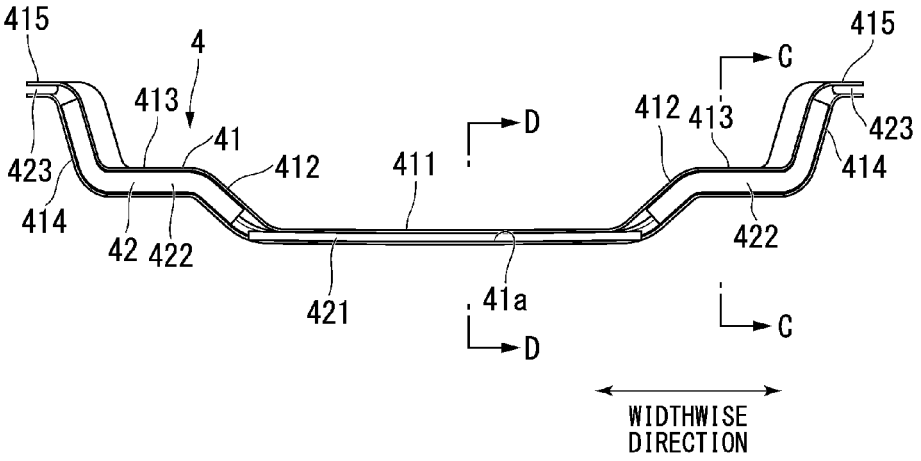
FIG. 8 is a view showing the seal member when seen from behind.

As shown in FIG. 4, the base section 61 has a front side portion 61*a* that is disposed along the front side portion 23 (see FIG. 3) of the functional part installation space 22. The front side portion 61*a* of the base section 61 has a first base bottom surface 611, a first base inclined surface 612, a second base bottom surface 613, a pair of second base inclined surfaces 614, and a pair of third base bottom surfaces 615. The first base bottom surface 611 is a substantially horizontal surface formed at an intermediate portion in the widthwise direction in the vicinity of the front edge portion. The first base inclined surface 612 is an inclined surface inclined gradually upward from both widthwise edge portions and a rear edge portion of the first base bottom surface 611 toward the widthwise outer side and the rear side. The second base bottom surface 613 is a substantially horizontal surface extending from both widthwise end portions and a rear edge portion of the first base inclined surface 612 toward the widthwise outer side and the rear side. The pair of second base inclined surfaces 614 is inclined surface inclined gradually upward from both widthwise end portions of the second base bottom surface 613 toward the outer side in the widthwise direction. The pair of third base bottom surfaces 615 extend from end portions of outer widthwise sides of the pair of second base inclined surfaces 614 toward the outer side in the widthwise direction.

The first base bottom surface 611 has an elongated shape elongated in the widthwise direction in a plan view. The first base inclined surface 612 is continuously disposed on the outer side of the first base bottom surface 611 and is formed in substantially a C shape opening at a front side in a plan view. The second base bottom surface 613 is continuously disposed on the outer side of the first base inclined surface 612 and is formed in substantially a C shape opening at a front side in a plan view.

The upper end sections of the pair of second base inclined surfaces 614 and the pair of third base bottom surfaces 615 are disposed at a height of the upper surface 2*a* of the toilet bowl main body 2.

As shown in FIG. 2, when the base section 61 is disposed in the functional part installation space 22, the first base bottom surface 611 is faced to the first concave section bottom surface 251 with a gap therebetween, the first base inclined surface 612 is faced to the first concave section inclined surface 252 with a gap therebetween, the second base bottom surface 613 is faced to the second concave section bottom surface 253 with a gap therebetween, the pair of second base inclined surfaces 614 is faced to the pair of second concave section inclined surfaces 254 with a gap therebetween, and the pair of third base bottom surfaces 615 is faced to the upper surface 2*a* of the toilet bowl main body 2.

A gap between the first base bottom surface 611 and the first concave section bottom surface 251 is referred to as a gap t1. Each of gaps between the pair of first base inclined surfaces 612 and the pair of first concave section inclined surfaces 252 are referred to as a gap t2. Each of gaps between the pair of second base bottom surfaces 613 and the pair of second concave section bottom surfaces 253 is referred to as a gap t3. Each of gaps between the pair of second base inclined surfaces 614 and the pair of second concave section inclined surfaces 254 is referred to as a gap t4. Each of gaps between the pair of third base bottom surfaces 615 and the upper surface 2*a* of the toilet bowl main body 2 is referred to as a gap t5. The gap t4 is set to a dimension larger than the gap t1, the gap t2, the gap t3 and the gap t5. Further, the gap t2 and the gap t3 are set to have a larger tolerance than the other gaps.

The seal member 4 is attached to at least one of the toilet bowl main body 2 and the functional part installation space 22. In the embodiment, as shown in FIGS. 5 to 9B, the seal member 4 is disposed in a gap between the vicinity of a front edge portion of the front side portion 61*a* of the base section 61 (see FIG. 2) and the vicinity of a front edge portion of the front side portion 23 of the functional part installation space 22. The seal member 4 is formed in a shape along a shape of a gap between the front side portion 61*a* of the base section 61 and the front side portion 23 of the functional part installation space 22. In the embodiment, the seal member 4 is mounted on the toilet bowl main body 2.

The seal member 4 is disposed along a front end portion of the second concave section bottom surface 253. In the embodiment, a portion (i.e. a first horizontal section 411 of a soft seal body 41 and a first elastic body 421 disposed at a hollow section 411*a* of the first horizontal section 411) of the seal member 4, that is disposed at the gap t1 between the first base bottom surface 611 and the first concave section bottom surface 251, is disposed along the front end portion of the second concave section bottom surface 253 (the front end portion of the first concave section bottom surface 251), and disposed slightly behind the front end portion of the second concave section bottom surface 253 as directed toward the outer side in the widthwise direction.

Figure 9A:
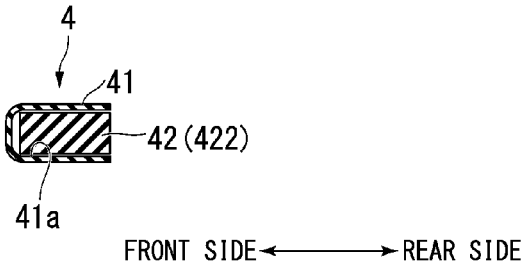
FIG. 9A is a cross-sectional view taken along line C-C of FIG. 8.
Figure 9B:
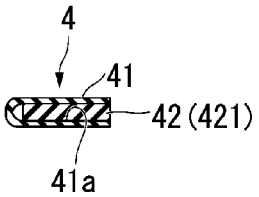
FIG. 9B is a cross-sectional view taken along line D-D of FIG. 8.

As shown in FIGS. 9A and 9B, the seal member 4 has the soft seal body 41 having flexibility and a cross-sectional shape of which is formed in a substantially U-shaped string shape, and an elastic body 42 that is elastically deformable and disposed in the soft seal body 41.

When a portion on an inner side of the soft seal body 41 having substantially a U shape in a cross-sectional shape is a hollow section 41*a*, the elastic body 42 is disposed in the hollow section 41*a* of the soft seal body 41.

The seal member 4 is disposed such that substantially the U shape in the cross-sectional shape of the soft seal body 41 opens at a rear side, an upper side, a lower side and a front side of the elastic body 42 are covered by the soft seal body 41, and the front side of the elastic body 42 is disposed not to be exposed.

The soft seal body 41 is formed of a vinyl chloride resin or the like and has a waterproof property.

The soft seal body 41 has the first horizontal section 411, a pair of first inclined sections 412, a pair of second horizontal sections 413, a pair of second inclined sections 414, and a pair of third horizontal sections 415. The first horizontal section 411 is disposed in the gap t1 between the first base bottom surface 611 and the first concave section bottom surface 251. The pair of first inclined sections 412 continues to both widthwise end portions of the first horizontal section 411 and is disposed in the gap t2 between the pair of first base inclined surfaces 612 and the pair of first concave section inclined surfaces 252, The pair of second horizontal sections 413 continues to end portions of the widthwise outer side of the pair of first inclined sections 412 and is disposed in the gap t3 between the pair of second base bottom surfaces 613 and the pair of second concave section bottom surfaces 253. The pair of second inclined sections 414 continues to end portions of the widthwise outer side of the pair of second horizontal sections 413 and is disposed in the gap t4 between the pair of second base inclined surfaces 614 and the pair of second concave section inclined surfaces 254. The pair of third horizontal sections 415 continues to end portions of the widthwise outer side of the pair of second inclined sections 414 and is disposed in the gap t5 between the pair of third base bottom surfaces 615 and the upper surface 2*a* of the toilet bowl main body 2.

The first horizontal section 411, the pair of first inclined sections 412, the pair of second horizontal sections 413, the pair of second inclined sections 414, and the pair of third horizontal sections 415 are integrally formed. In the embodiment, the gap t4 between the second base inclined surface 614 and the second concave section inclined surface 254 is larger than the other gaps t1 to t3 and t5, and the gap t2 between the first base inclined surface 612 and the first concave section inclined surface 252 and the gap t3 between the second base bottom surface 613 and the second concave section bottom surface 253 have a tolerance larger than that of the gaps t1, t4 and t5. For this reason, the pair of first inclined sections 412, the pair of second horizontal sections 413, and the pair of second inclined sections 414 are formed such that a thickness of the hollow section 41*a* and the entire thickness are larger than that of the first horizontal section 411 and the pair of third horizontal sections 415.

The elastic body 42 is formed of urethane, sponge, rubber, gel, or the like. The elastic body 42 may not be formed of a material having a highly waterproof property as long as the elastic body is elastically deformable. The elastic body 42 is mounted on the soft seal body 41.

The elastic body 42 has the first elastic body 421, the pair of second elastic bodies 422, and the pair of third elastic bodies 423. The first elastic body 421 is disposed in the hollow section 41*a* of the first horizontal section 411 of the soft seal body 41. The pair of second elastic bodies 422 is disposed in each of the hollow sections 41*a* of the first inclined section 412, the second horizontal section 413 and the second inclined section 414 that are continued inside the soft seal body 41. The pair of third elastic bodies 423 is disposed in the hollow section 41*a* of the pair of third horizontal sections 415 of the soft seal body 41.

The first elastic body 421, the pair of second elastic bodies 422 and the pair of third elastic bodies 423 are formed separately. In the embodiment, gaps are formed between the pair of second elastic bodies 422 adjacent to the first elastic body 421 and between the pair of third elastic bodies 423 adjacent to the pair of second elastic bodies 422.

In the embodiment, the first elastic body 421 and the pair of third elastic bodies 423 are formed to have a height dimension smaller than that of the pair of second elastic bodies 422, and correspond to a size of the soft seal body 41.

The seal member 4 is configured such that the elastic body 42 is elastically deformed by an external force, the soft seal body 41 is deformed to follow the elastic deformation of the elastic body 42, and a repulsive force of the elastic body 42 is transmitted to the soft seal body 41.

Figure 10:
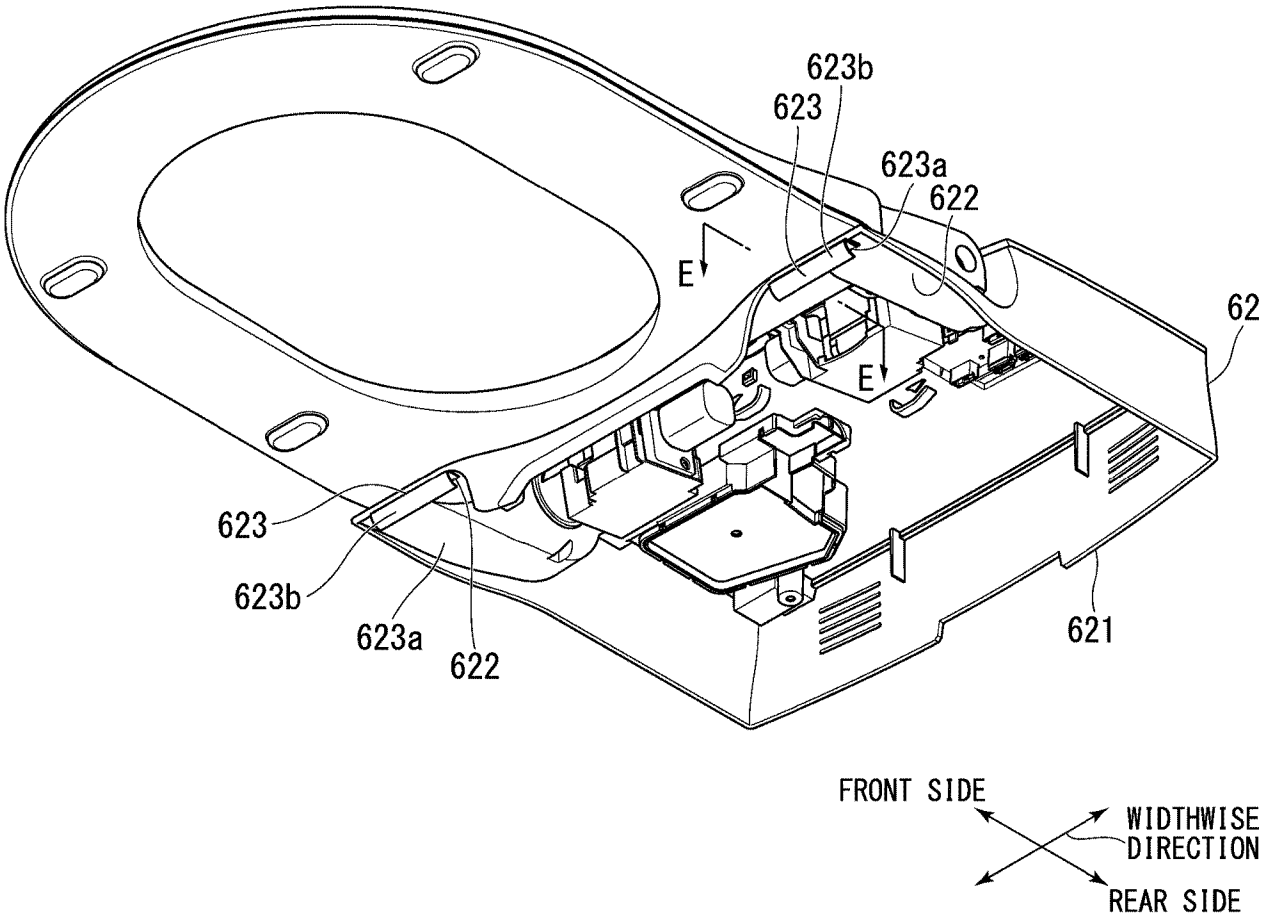
FIG. 10 is a perspective view showing a cover section when seen from below.

As shown in FIG. 10, the cover section 62 has a housing section 621 and a pair of cover plates 622. The housing section 621 covers the functional part 3 from above. The pair of cover plates 622 has a plate shape and protrudes forward from the vicinity of both widthwise end portions of the front end portion of the housing section 621.

When the cover section 62 is disposed at a normal position to accommodate the functional part 3, the pair of cover plates 622 covers the pair of third base bottom surfaces 615 and front end portions of the pair of cover plates 622 are located in front of the front end portions of the pair of third base bottom surfaces 615. The portions of the pair of cover plates 622 in front of the pair of third base bottom surfaces 615 are disposed along the upper surface 2*a* of the toilet bowl main body 2.

Figure 11:
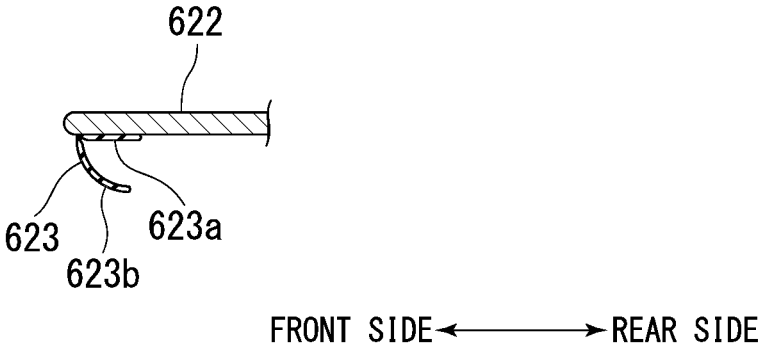
FIG. 11 is a cross-sectional view taken along line E-E of FIG. 10.

In the embodiment, as shown in FIGS. 10 and 11, packings 623 extending in the widthwise direction are installed at lower surfaces in the vicinity of the front end portions of the pair of cover plates 622. Each of the packings 623 is sandwiched between the cover plates 622 and the toilet bowl main body 2, and the end portion positioned at the inner side in the widthwise direction is disposed to abut the end portion of the widthwise outer side of the seal member 4.

The packings 623 are formed of vinyl chloride resin or the like, and have a waterproof property. A cross-sectional shape of the packings 623 is substantially an L shape. In the packings 623, one sides 623*a* are adhered to lower surfaces of the cover plates 622, and the other sides 623*b* protrude downward obliquely. The packings 623 are deformed to overlap the sides thereof each other when the packings 623 are sandwiched between the lower surfaces of the cover plates 622 and the upper surface 2*a* of the toilet bowl main body 2.

Next, actions and effects of the toilet bowl apparatus and the seal member will be described with reference to the accompanying drawings.

In the above-mentioned embodiment, the seal member 4 has the soft seal body 41, and the elastic body 42 covered by the soft seal body 41. Accordingly, when the seal member 4 is disposed in the gap between the toilet bowl main body 2 and the functional part 3 and the elastic body 42 is elastically deformed to have a shape so as to follows the gap between the toilet bowl main body 2 and the functional part 3, the soft seal body 41 is capable of being close contacted with the toilet bowl main body 2 and the functional part 3, and the soft seal body 41 is prevented from being buckled by the repulsive force of the elastic body 42.

Since the seal member 4 is capable of reliably filling the gap between the toilet bowl main body 2 and the functional part 3, water or the like scattered from the bowl 21 does not intrude into the gap between the toilet bowl main body 2 and the functional part 3, and time and effort for cleaning the toilet is capable of being reduced.

As the concave section 25 in which at least a lower section side of the functional part 3 is disposed is formed in the toilet bowl main body 2 and the seal member 4 is disposed in the gap between the bottom surface of the concave section 25 and the functional part 3, a height at which the functional part is installed can be reduced in comparison with the case in which the functional part is disposed at upper side than the upper end section of the toilet bowl main body 2, and the toilet bowl apparatus 1 having a low height in a compact design is capable of provided.

Although a position at which the gap between the toilet bowl main body 2 and the functional part 3 is lowered and water is likely to enter the gap between the toilet bowl main body 2 and the functional part 3 in comparison with the case in which the functional part is disposed at upper side than the upper end section of the toilet bowl main body, as the seal member 4 is disposed in the gap, water is capable of being prevented from intruding into the gap between the toilet bowl main body 2 and the functional part 3.

As the soft seal body 41 has a U shape in a cross-sectional shape and the elastic body 42 is disposed inside the soft seal body 41, the soft seal body 41 and the elastic body 42 are close contacted with each other and the repulsive force of the elastic body 42 is reliably applied to the soft seal body 41. Thereby, the seal member 4 is capable of following the shape of the gap between the toilet bowl main body 2 and the functional part 3 and is capable of reliably filling the gap between the toilet bowl main body 2 and the functional part 3.

As the seal member 4 has a configuration in which a thickness is partially different according to the dimensions of the gap between the toilet bowl main body 2 and the functional part 3, even when a size of the gap between the toilet bowl main body 2 and the functional part 3 varies, since the seal member 4 has a shape corresponding to the shape of the gap between the toilet bowl main body 2 and the functional part 3, the seal member 4 is capable of reliably filling the gap between the toilet bowl main body 2 and the functional part 3.

In the embodiment, as the packings 623 disposed between the cover plates 622 and the upper surface 2*a* of the toilet bowl main body 2 are installed separately from the seal member 4, even when the cover section 62 is moved with respect to the toilet bowl main body 2 together with the packings 623, a movement of the packings 623 does not influence to the seal member 4 and the seal member 4 is capable of being be prevented from being deviated.

Hereinabove, while the embodiment of the toilet bowl apparatus and the seal member according to the present invention has been described, the present invention is not limited to the embodiment but may be appropriately modified without departing from the spirit of the present invention.

For example, in the embodiment, while the concave section 25 recessed downward is formed in the functional part installation space 22 of the toilet bowl main body 2, the concave section 25 may not be formed and may be formed in a flat surface. In addition, when the concave section 25 is formed in the functional part installation space 22 of the toilet bowl main body 2, shapes of the concave section 25 and the base section 61 may be appropriately set.

In addition, in the embodiment, while the seal member 4 is adhered to the toilet bowl main body 2, the seal member 4 may be adhered to the base section 61 instead of the toilet bowl main body 2.

In the embodiment, while the gap t4 between the pair of second base inclined surfaces 614 and the pair of second concave section inclined surfaces 254 is set to a dimension larger than the gap t1 between the first base bottom surface 611 and the first concave section bottom surface 251, the gap t2 between the pair of first base inclined surfaces 612 and the pair of first concave section inclined surfaces 252, the gap t3 between the pair of second base bottom surfaces 613 and the pair of second concave section bottom surfaces 253 and the gap t5 between the pair of third base bottom surfaces 615 and the upper surface 2*a* of the toilet bowl main body 2, a size of each of the gaps t1 to t5 may be appropriately set. Further, all of the gaps t1 to t5 may be set to the same size. In addition, in the embodiment, while the gap t2 and the gap t3 are set to have a tolerance larger than that of the other gaps t1, t4 and t5, the gaps may not be set as described above. With this, the dimensions of the seal member 4 may be appropriately set.

In the embodiment, while the soft seal body 41 has substantially a U shape in the cross-sectional shape, the soft seal body 41 may have another shape as long as the elastic body 42 is covered in order not to be exposed at a front side from the gap between the toilet bowl main body 2 and the base section 61.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A toilet bowl apparatus comprising:

a toilet bowl main body;

a functional part installed at an upper section of the toilet bowl main body;

a seal member attached to at least one of the toilet bowl main body and the functional part and disposed in a gap between the toilet bowl main body and the functional part, wherein the seal member has a soft seal body and an elastic body covered by the soft seal body, and the elastic body is disposed on an inner side of the soft seal body.

2. The toilet bowl apparatus according to claim 1, wherein a concave section is formed in the toilet bowl main body, at least a lower section side of the functional part is disposed in the concave section, and the seal member is disposed in a gap between a bottom surface of the concave section and the functional part.

3. The toilet bowl apparatus according to claim 1, wherein the soft seal body has a U shape in a cross-sectional shape.

4. The toilet bowl apparatus according to claim 1, wherein the seal member has a thickness that is different in accordance with dimensions of the gap between the toilet bowl main body and the functional part.

5. The toilet bowl apparatus according to claim 2 wherein the soft seal body has a U shape in a cross-sectional shape.

6. The toilet bowl apparatus according to claim 2, wherein the seal member has a thickness that is different in accordance with dimensions of the gap between the toilet bowl main body and the functional part.

7. The toilet bowl apparatus according to claim 3, wherein the seal member has a thickness that is different in accordance with dimensions of the gap between the toilet bowl main body and the functional part.

8. The toilet bowl apparatus according to claim 1, wherein the soft seal body has a U shape in a cross-sectional shape and the elastic body is disposed on an inner side that is formed by forming the soft seal body into the U shape.

9. The toilet bowl apparatus according to claim 1, wherein the elastic body is covered by the soft seal body such that a part of the elastic body is exposed.

* * * * *